US006047486A

United States Patent [19]

Reck et al.

[11] Patent Number: 6,047,486

[45] Date of Patent: Apr. 11, 2000

[54] CONTROL SYSTEM FOR A DRYER

[75] Inventors: Andrew C. Reck, Watervliet, Mich.; Joseph Martin Szynal; Gerald C. Stenger, both of Laporte, Ind.; Michael E. Range, Stevensville, Mich.

[73] Assignee: Whirlpool Corporation, Benton Harbor, Mich.

[21] Appl. No.: 09/146,833

[22] Filed: Sep. 3, 1998

[51] Int. Cl.[7] ..... F26B 3/02

[52] U.S. Cl. ..... 34/491; 34/543; 34/563; 34/550; 34/497

[58] Field of Search ..... 34/550, 543, 563, 34/527, 553, 564, 491, 497

[56] References Cited

U.S. PATENT DOCUMENTS

| | | | |
|---|---|---|---|
| 3,059,344 | 10/1962 | Conlee | 34/45 |
| 3,401,464 | 9/1968 | Fogt et al. | 34/45 |
| 3,714,717 | 2/1973 | Beard et al. . | |
| 3,762,064 | 10/1973 | Offutt | 34/45 |
| 4,385,452 | 5/1983 | Deschaaf et al. | 34/53 |
| 4,397,101 | 8/1983 | Rickard | 34/30 |
| 4,412,389 | 11/1983 | Kruger | 34/46 |
| 4,422,247 | 12/1983 | Deschaaf | 34/48 |
| 4,477,982 | 10/1984 | Cotton | 34/48 |
| 4,531,305 | 7/1985 | Nagayasu et al. | 34/31 |
| 4,738,034 | 4/1988 | Muramatsu et al. | 34/43 |
| 5,113,124 | 5/1992 | Hamilton | 318/578 |
| 5,128,661 | 7/1992 | Fowler | 340/706 |
| 5,150,489 | 9/1992 | Kaji et al. | 8/159 |
| 5,189,355 | 2/1993 | Larkins et al. | 318/685 |
| 5,204,600 | 4/1993 | Kahkosha | 318/602 |
| 5,211,037 | 5/1993 | Adamski et al. | 68/12.16 |
| 5,291,667 | 3/1994 | Joslin et al. | 34/44 |
| 5,301,438 | 4/1994 | Tanaka et al. | 34/48 |
| 5,454,171 | 10/1995 | Ikeda et al. | 34/492 |
| 5,481,169 | 1/1996 | Turetta et al. | 318/560 |
| 5,570,520 | 11/1996 | Huffington | 34/535 |

*Primary Examiner*—Henry Bennett
*Assistant Examiner*—Malik N. Drake
*Attorney, Agent, or Firm*—Joel M. Van Winkle; Thomas J. Roth; Robert O. Rice

[57] ABSTRACT

A hybrid control for a clothes dryer which combines an electromechanical timer and a microprocessor. The electromechanical timer has a plurality of switches connected to a plurality of input ports of the microprocessor. The timer switches are driven by a plurality of cams such that the plurality of switches open and close in response to the cams at predetermined angular positions of the timer. In this manner, the switches provide control input to the electronic circuit for initiating the dry cycle and further provide control input to the electronic circuit during the dry cycle such that the electromechanical timer and the electronic circuit operate together to control the dryer operation. In addition, a sensor supplies a signal to the microprocessor corresponding to the moisture level of the clothes within the drum. If the dryer is operated in an automatic cycle of operation, the microprocessor operates to control operation of the clothes dryer in response to the initial timer position and advances the timer in response to the moisture sensor signal such that cycle status information corresponding to the sensed moisture level is displayed by the position of the timer knob. The microprocessor operates to drive the timer at different speeds depending on the cycle selection and control settings. The duration of the automatic dry cycle is responsive to the moisture level selected, the temperature level selected and the duration of the initial moisture sensing drying period.

16 Claims, 9 Drawing Sheets

TIMED CYCLE ENCODING

| INPUT | SWITCH | TIMED | COOL DOWN | WRINKLE GUARD | OFF |
|---|---|---|---|---|---|
| LINE 56a | 56 | | | ▨ | |
| LINE 54a | 54 | | ▨ | | |
| LINE 52a | 52 | | ▨ | ▨ | |
| LINE 50a | 50 | ▨ | ▨ | ▨ | |

Fig. 5

AUTOMATIC CYCLE ENCODING

| INPUT | SWITCH | MORE DRY | NORMAL DRY | DAMP DRY | WRINKLE GUARD | OFF |
|---|---|---|---|---|---|---|
| LINE 56a | 56 | ▨ | | | ▨ | |
| LINE 54a | 54 | | ▨ | | | |
| LINE 52a | 52 | | | ▨ | ▨ | |
| LINE 50a | 50 | ▨ | ▨ | ▨ | ▨ | |

Fig. 6

COTTON ADD-ON TIME

| DRYNESS SETTING | RUN TIME (START OF CYCLE TO ADD-ON-TIME) | | | | | | | | | | | |
|---|---|---|---|---|---|---|---|---|---|---|---|---|
| | 0 TO 5 M. | 5 TO 10 M. | 10 TO 15 M. | 15 TO 20 M. | 20 TO 25 M. | 25 TO 30 M. | 30 TO 35 M. | 35 TO 40 M. | 40 TO 45 M. | 45 TO 50 M. | 50 TO 55 M. | 55 TO 150 M. |
| MORE | 5 | 6 | 6 | 6 | 6 | 7 | 7 | 12 | 13 | 13 | 13 | 13 |
| NORMAL | 4 | 5 | 6 | 6 | 7 | 7 | 7 | 8 | 10 | 10 | 12 | 12 |
| DAMP | 3 | 3 | 3 | 3 | 3 | 3 | 3 | 3 | 3 | 3 | 3 | 3 |

CONTROL SYSTEM FOR A DRYER

BACKGROUND OF THE INVENTION

1. Field of the Invention

This invention relates generally to the field of control circuitry for appliances and more particularly to a control system for a clothes dryer.

2. Description of the Related Art

It has been common practice to provide automatic clothes dryers with an electromechanical timer which the user manipulates to select the desired dryer cycle. The electromechanical timer provides a means for the user to input desired control information and it also operates to switch on various machine loads. While the use of a electromechanical timer is a cost effective and familiar control device for operating a dryer, there are some disadvantages in a timer based control system. For example, when using a timer in a straight timed setting manner, the user typically must estimate, based on experience, the amount of time needed to dry a particular load. Such estimating can result in under or over drying.

In an effort to overcome the shortcomings of a straight time setting, many dryers are provided with a certain degree of automatic control based upon sensing load dryness. The typical approach utilizes a moisture sensor device in combination with an electromechanical dryer. The clothes dryer is operated with the timer de-activated until a preselected dryness condition is sensed at which point the timer, which is set by the user, is activated. The drying cycle is terminated when the timer times out. While combining a moisture sensor means with a timer does make the control more responsive to the clothes condition, these systems are relatively inaccurate, inflexible and often result in longer drying times than actually necessary.

Electronic controls offer an alternative to the traditional electromechanical timer based dryer controls and can be used to improve the dryer cycle responsiveness to the sensed moisture in a clothes load. For example, U.S. Pat. No. 3,762,064, to Offut, discloses a fully electronic dryer control system for a clothes dryer wherein the length of the dry cycle is responsive to the sensed dryness of the clothes. Clothes dryness is sensed by a pair of electrodes. To ensure complete drying, an add-on interval of time is added to the end of the sensed drying period. The duration of the "add-on" time is dependent on the length of the sensed drying interval and the dryness condition selected by the user at the initiation of the drying cycle.

U.S. Pat. No. 4,477,982, to Cotton, discloses a fully electronic, microprocessor based control system which senses the moisture content of clothes in a dryer drum via moisture sensing sensors or electrodes. The sensors are engagable with wet fabrics for completing an electrical current path therethrough wherein input signals are supplied to the microprocessor responsive to the completion of the electrical current path through the sensors. Counting apparatus is associated with the microprocessor for accumulating a count of the input signals. The microprocessor is operable for initiating termination of the fabric drying cycle when series of signals fail to accumulate to at least a predetermined number in a predetermined sensing time period.

While fully electronic systems offer some opportunities to enhance dryer performance and responsiveness to the sensed dryness condition, there are also some disadvantages. Specifically, electronic dryer control systems do not provide a ready way to communicate the status of the drying operation to the user unless a relatively expensive electronic display is provided. Moreover, dryer users are more familiar and comfortable with electromechanical timer type control systems for dryers.

U.S. Pat. No. 5,481,169, to Turetta et al., is an example of an effort to provide a microprocessor based appliance control system with the benefits of a traditional timer selector knob. In this reference, a stepping type motor is connected through a gear drive system to a selector knob. The selector knob is meant to provide an appearance and functionality similar to the conventional electromechanical timer knob. The position of the selector knob is communicated to a microprocessor via a potentiometer, an angular transducer or any known switch. In this manner the selector knob can be used to input data to the microprocessor and the microprocessor can energize the stepping type motor to rotate the selector knob and communicate cycle information to the user. While this control system offers some benefits, it still is relatively costly and does not combine an electromechanical timer having cam operated switches with a microprocessor. Moreover, this system does not provide a manner of operating a clothes dryer to minimize dry cycle length based on sensed dryness condition while providing feedback through the operation of a timer during the drying cycle.

Accordingly, it would be an improvement in the art to combine the cost effectiveness, familiarity and cycle progress feedback features of an electromechanical timer control system with the improved control sophistication and responsiveness of a microprocessor based control system. Moreover, it would be an improvement in the prior art to more accurately determine the length of dry time needed to adequately dry clothes in clothes dryer having a combined or hybrid electromechanical timer and microprocessor control.

SUMMARY OF THE INVENTION

According to the present invention, there is provided a hybrid control for a clothes dryer which combines an electromechanical timer and an electronic circuit or microprocessor. The clothes dryer has a drum for receiving clothes, a drive motor for rotating the drum and for operating a blower to circulate air through the drum and a heater for heating air circulating through the drum. The electromechanical timer has a plurality of switches connected to a plurality of input ports of the microprocessor. The timer switches are driven by a plurality of timer cams such that the plurality of switches open and close in response to the cams at predetermined angular positions. In this manner, the switches provide control input to the electronic circuit for initiating the dry cycle and further provide control input to the electronic circuit during the dry cycle such that the electromechanical timer and the electronic circuit operate together to control the dryer operation. A sensor supplies a signal to the microprocessor corresponding to the moisture level of the clothes within the drum. A timer knob is drivingly connected to the timer such that the initial timer position can be set by the dryer operator to input a desired automatic cycle operation or a timed cycle operation. The microprocessor operates to control operation of the clothes dryer in response to the initial timer knob position and advances the timer in response to the moisture sensor signal such that cycle status information corresponding to the sensed moisture level is displayed by the position of the timer knob.

The timer includes a timer motor which is connected to a speed reducer gear system for driving an output shaft on which the timer knob is mounted. The microprocessor operates to energize the motor when timer movement is desired. The speed reduction ratio is relatively high such that the timer knob may be rapidly advance when desired. The microprocessor operates to drive the timer motor according to a first duty cycle during the timed cycle operation and according to a second duty cycle during the automatic dry cycle operation.

The dryer further includes means for selecting a desired drying temperature such as a rotary switch. During the automatic dry cycle, the microprocessor operates the dryer for a first drying period, wherein during the first drying period the drive motor is energized and the heater is intermittently energized to maintain the selected drying temperature until a moisture level correlated to the desired dryness is sensed. After the first drying period is complete, the processor continues operation of the drive motor and intermittent energization of the heater for an additional time based on the desired dryness level, the selected temperature and the time elapsed during the first drying period.

BRIEF DESCRIPTION OF THE DRAWINGS

FIG. 5 is a timing chart for the timer shown in FIG. 3 which shows the timer switch sequence during the timed dry cycle.

FIG. 6 is a timing chart for the timer shown in FIG. 3 which shows the timer switch sequence during the automatic dry cycle.

DESCRIPTION OF THE PREFERRED EMBODIMENT

Figure 1:
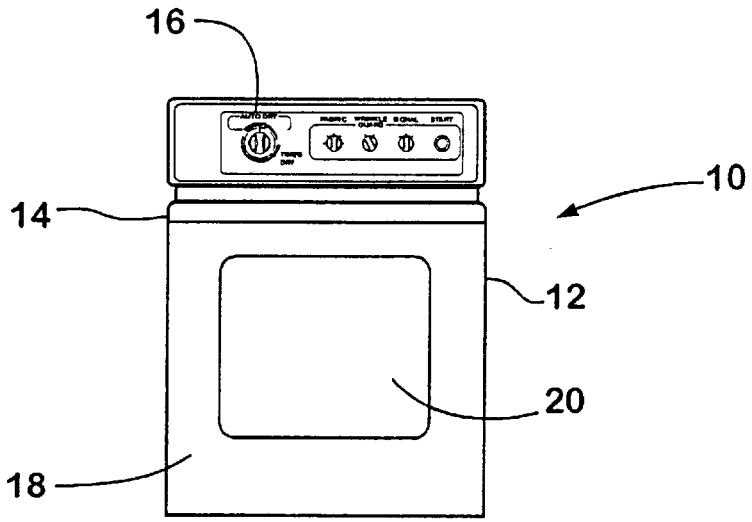
FIG. 1 is a front elevational view of a clothes dryer appliance according to the present invention.

Referring now to the drawings and in particular to FIG. 1, there is shown a free-standing fabric drying appliance 10 having a cabinet 12 and a top panel 14. Extending upwardly from the top panel 14 is a control console 16 for mounting various control members as will be further described herein. The cabinet 12 further includes a front surface 18 having a hinged door 20 for accessing the interior of the dryer drum, as is known.

Figure 2:
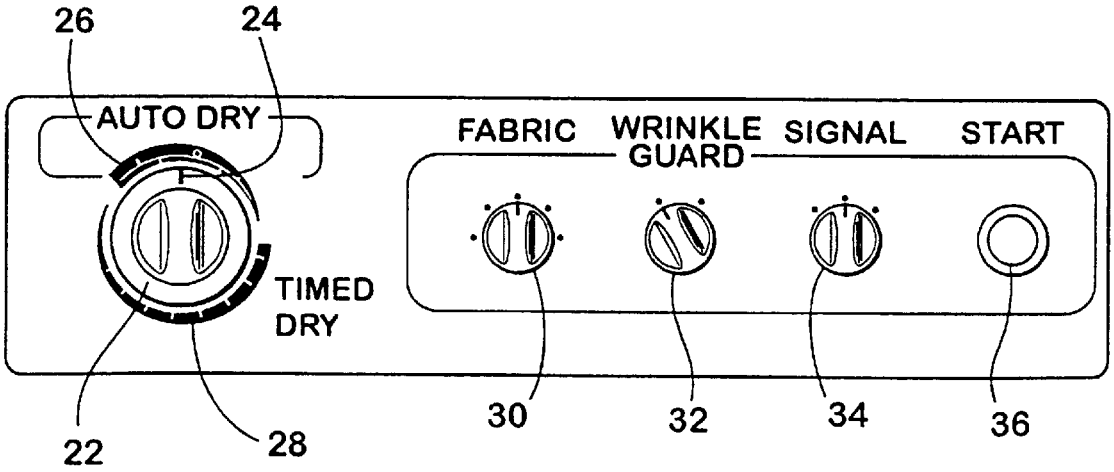
FIG. 2 is a detailed view of the control panel of the clothes dryer according to the present invention shown in FIG. 1.

FIG. 2 shows the control console is greater detail. A timer knob 22 is provided for allowing the dryer user to select an automatic cycle of operation and a timed dry cycle of operation. Specifically, the knob 22 may be rotated by the user to position the indicator marking 24 in the auto dry region 26 for selecting the automatic cycle of drying or the knob 22 may be rotated to position the indicator marking 24 in a timed dry region 28 for selecting the timed dry cycle. Within the auto dry region 26, the user may select between a "MORE DRY" position, a "NORMAL DRY" position and a "DAMP DRY" position. Within the timed dry region 28, the knob 22 may be rotated to select the desired quantity of drying time. Both the timed dry region and the auto dry region conclude with a WRINKLE GUARD portion and then terminate in an "OFF" position.

The control console 16 further includes a fabric temperature selector dial 30 allowing the user to select between "NO HEAT", "EXTRA LOW", "LOW", "MEDIUM" and "HIGH" heat levels. The temperature selected by the user corresponds to the type of fabric being dried: HIGH for cotton items, MEDIUM for permanent press items, LOW for knit items and EXTRA LOW for hand washables. Selector dials 32 and 34 may also be provided for allowing the user to select the wrinkle guard feature and an end-of-cycle signal. A push-to-start button 36 is provided for allowing the user to initiate the dryer operation after the cycle selections have been made.

Figure 3A:
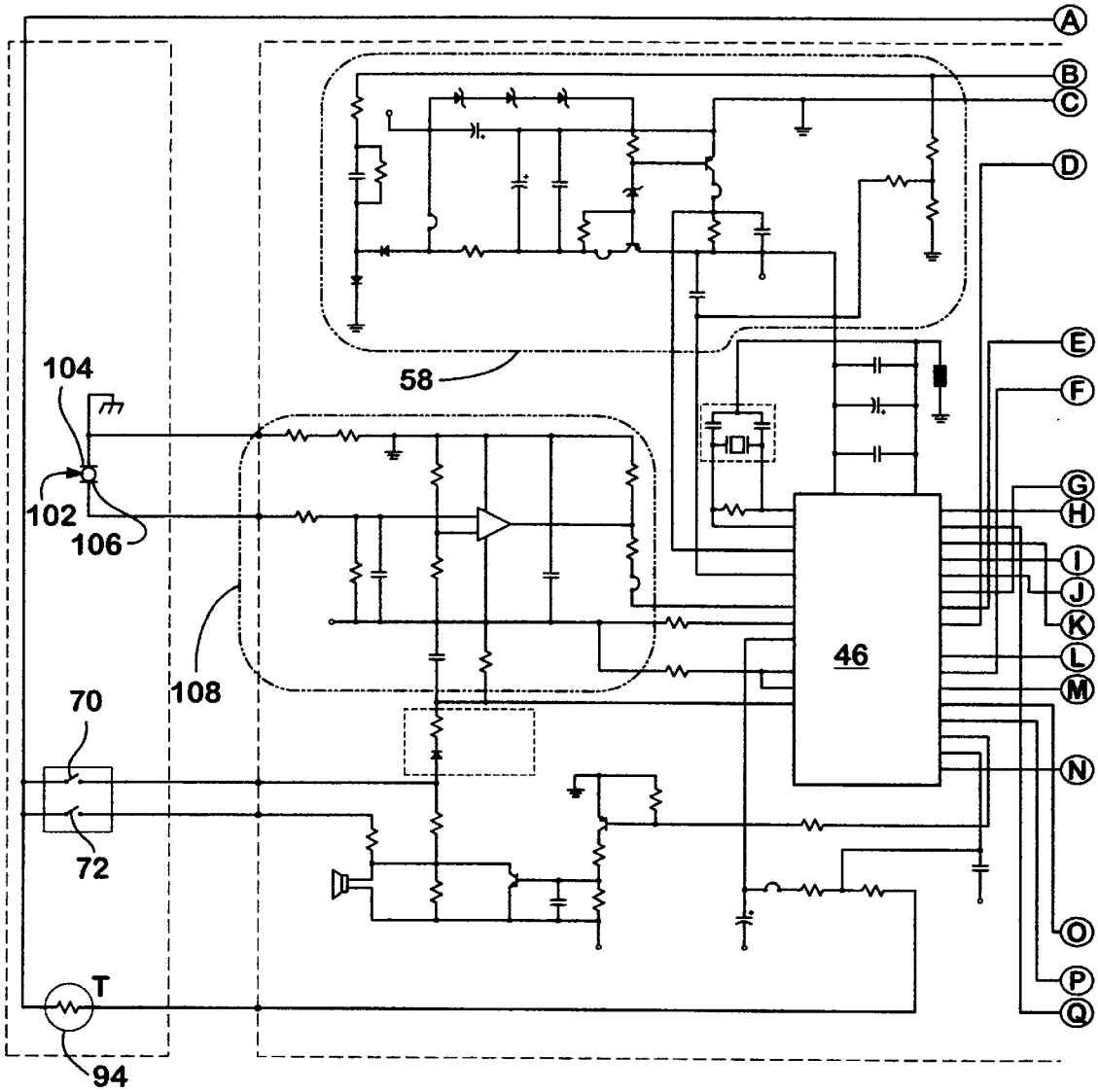
FIG. 3A is the first half of electrical schematic circuit diagram for the clothes dryer according to the present invention.
Figure 3B:
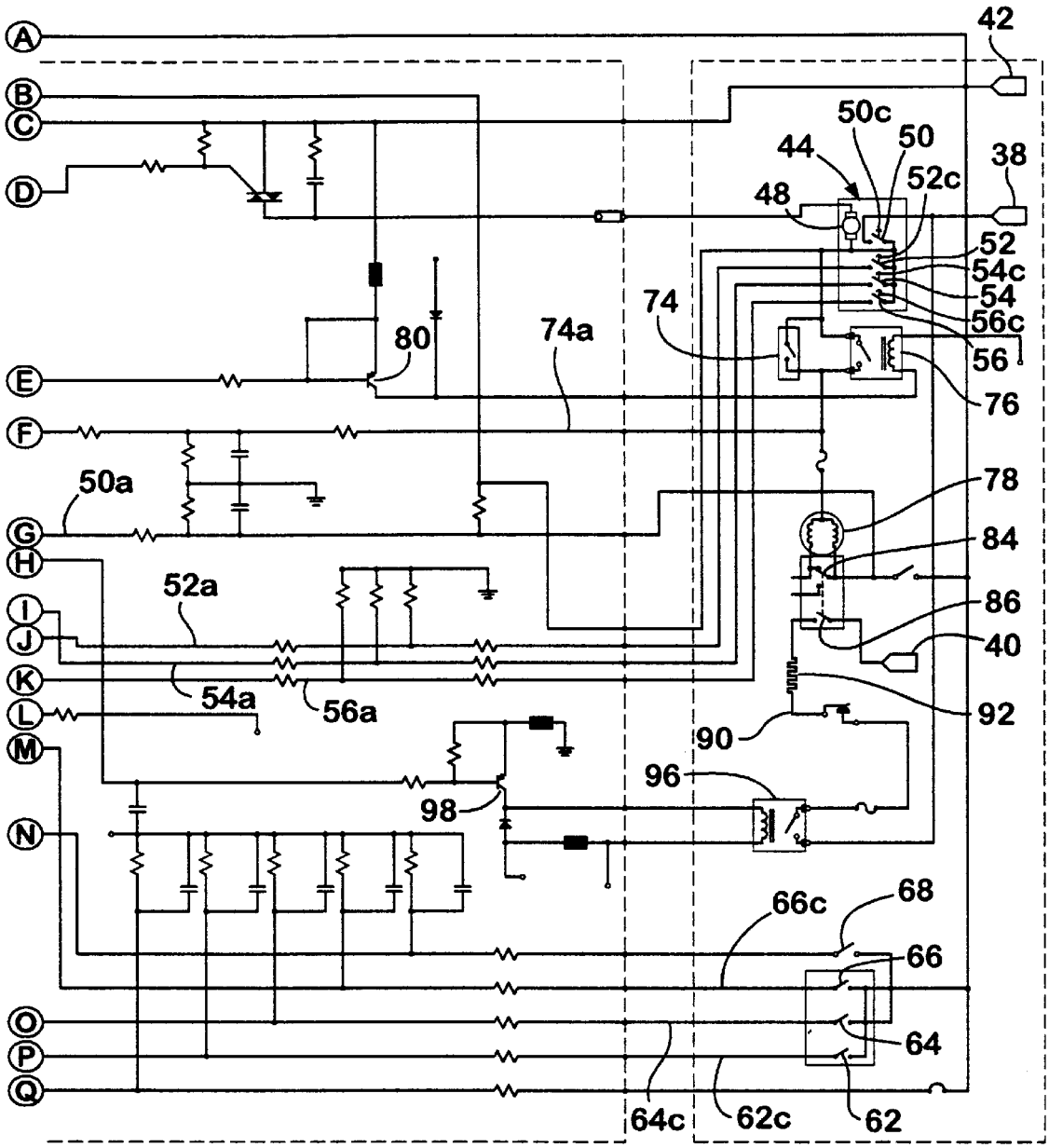
FIG. 3B is the second half of the electrical schematic circuit diagram for the clothes dryer according to the present invention.

To provide for a cost effective dryer control which quickly dries clothes and is responsive to sensed conditions, the dryer 10 is provided with a unique hybrid electromechanical timer and microprocessor control system as shown in FIGS. 3A and 3B. The control circuitry includes three power supply conductors 38, 40 and 42 which are connectable with a three wire 240 volt, alternating current power source. For purposes of explanation of FIGS. 3A and 3B, it will be assumed that the conductors 38 and 40 are connected with the power lines and that the neutral conductor 42 is connected to the earth grounded neutral line. It can be readily appreciated by one of ordinary skill in the art that the present invention is not limited to a 240 volt power supply but could also operate from a 120 volt power supply and a gas product supply.

The control system of the present invention includes an electromechanical timer 44 and a microprocessor 46. The timer 44 includes a timer motor 48, a main switch 50 and an array of switches 52, 54 and 56. When the user moves the timer knob 22 from one of the "OFF" positions, the main switch 50 is closed which supplies power to a power supply circuit, generally enclosed by broken line 58, such that a constant voltage level is supplied to the microprocessor 46.

The switches 50, 52, 54 and 56 are cam operated switches which open and close in response to the timer cams, shown as 50*c*, 52*c*, 54*c* and 56*c*, driven by the timer motor 48. The switches 50, 52, 54 and 56 are connected to the microprocessor through lines 50*a*, 52*a*, 54*a* and 56*a* such that the switch status information is input to the microprocessor. In this manner, the position of the timer knob 22 may be used to input to the microprocessor 46 the desired cycle of operation and to signal when various operations need to occur. For example, when just switch 50 is closed at the initiation of a dryer cycle, the microprocessor executes the timed dry operation. When switch 50 and one of the switches 52, 54 or 56 is also closed, then the microprocessor executes the automatic dry operation according to the selected dryness as will be discussed further below. Moreover, as the timer 44 is driven through its rotation by the timer motor 48, the cams of the timer open and close the switches 52, 54 and 56 to supply signals to the microprocessor 46 to take certain actions. In particular, the three switches 52, 54 and 56 can be configured in eight different logic states which are used to communicate information to the microprocessor. In this way, the timer 44 serves as a means for inputting initial cycle operation information and also provides control information to the microprocessor 46 during the dryer cycle. In can be readily understood that more or fewer cams can be used to provide more or less information to the microprocessor and the particular number of switches and logic states described above is not meant to be a limitation on the present invention.

As discussed above, in addition to the timer 44, there are selector dials 30, 32 and 34 for inputting a user's cycle preference. Switches 62, 64 and 66 are associated with the fabric temperature selector 30 for inputting the selected temperature to the microprocessor on lines 62*a*, 64*a* and 66*a*. The switch 68 is associated with the wrinkle guard selector dial 32. Switches 70 and 72 are associated with the end of cycle signal selector knob 34.

A push-to-start (PTS) switch 74 is associated with the push-to-start button 36. The PTS switch 74 is a momentary switch used to start the selected drying cycle. The status of the PST switch 74 is communicated to the microprocessor 46 on line 74*a*. The PTS switch 74 is wired in parallel with a motor relay 76 and supplies 120 VAC to the drum motor 78 through the timer switches. The microprocessor 46 latches the motor relay 76 by turning on transistor 80 within 200 ms of the PTS switch 74 closure. Accordingly, when the PTS switch releases, the motor 78 is supplied with power through the motor relay 76 switch.

A pair of centrifugally operated switches 84 and 86 are associated with the motor and change status when the motor is energized and deenergized. Switch 84 disconnects the start winding of the motor after the initial motor start. Switch 86 is provided on line 90 such that when switch 86 is closed, 240 VAC power is supplied across a heater 92. The heater 92 is cycled on and off by the microprocessor 46 in response to input from the thermistor 94 located in the blower housing (not shown). Heater control is effected through operation of the heater relay 96 which is controlled via transistor 98.

The upper and lower temperatures at which the thermistor cycles the heater 92 on and off are varied in response to the user's temperature setting selection made via selector knob 30. The table T1, shown below, illustrates the various temperature settings.

TABLE T1

| Temperature Settings: | Upper Temperatures: | Lower Temperatures: |
|---|---|---|
| HIGH | 150° F. | 138° F. |
| MEDIUM | 140° F. | 128° F. |
| LOW | 125° F. | 115° F. |
| EXTRA LOW | 115° F. | 105° F. |

A door switch 100 associated with the hinged door 20 is connected in series with the motor 78. When the door is open, switch 100 opens, deenergizing the motor 78. Upon de-energization of the motor, the centrifugal switch 86 is opened, deenergizing the heater Reenergizing the motor requires closing the door 20 and pushing the PTS button 36.

The control circuit shown in FIGS. 3A and FIG. 3B further includes a means for sensing the moisture level of clothes within the dryer drum. The moisture sensing means includes a moisture sensor 102 having a pair of electrodes 104, 106 which are positioned within the dryer drum spaced apart from each other in such a manner as to come into contact with conductive materials such as wet fabrics as they are tumbled during a dry cycle. The electrodes 104, 106 are connected to a moisture sensing circuit 108, which is similar to the moisture sensing circuit disclosed in U.S. Pat. No. 4,385,452, to Deschaaf et al., herein incorporated by reference.

The sensing circuit 108 provides input into the microprocessor 46 such that the microprocessor may detect when a current path is completed across the electrodes, which may be referred as a wet sample. The microprocessor repetitively reads the input from the sensor circuit at very short intervals. Specifically, the microprocessor sampling rate is four times per 60 Hz line cycle for a total of eight lines cycles. A wet signal is generated if during one of these sampling intervals, the microprocessor reads all wet samples. In this manner, 32 sequential wet samples during a sampling interval equals a wet signal. If during a counting period, the duration of which is pre-selected as explained herein below, the microprocessor reads a wet signal, the microprocessor resets a search counter. As the clothes load continues to dry, valid wet signals decrease until a sufficient length of time between valid wet signals occurs allowing the search counter to run out. When the search counter has run out, the sensing portion of the process will end and the control circuit will cause the remainder of the selected program to continue.

FIGS. 4A, 4B, 4C, 4D, 5 and 6 illustrate the operation of the hybrid microprocessor/timer control system of the present invention during a drying cycle of operation. FIGS. 4A–4D are in functional block diagram form, with the various blocks indicating steps performed in sequenced during the performance of the method of the present invention. FIGS. 5 and 6 illustrate the timer switch encoding indicating the signals received by the microprocessor 46 during various periods of the timed dry cycle and automatic dry cycle.

The first step 110 in the initiation of the dryer cycle is for the user to move the timer knob 22 to select a dryer cycle of operation. Either prior or subsequent to this step, the user inputs his desired dryer cycle options via the selector dials 30, 32 and 34. In step 112, the microprocessor 46 reads the input from the timer to determine if the automatic cycle or timed cycle of drying has been selected. As shown in FIG. 5, if only switch 50 is closed, the timed cycle is selected. As shown in FIG. 6, if the switch 50 along with either 53, 54 or 56 are selected, the automatic cycle is initiated according to the "MORE DRY", "NORMAL DRY" OR "DAMP DRY" option selected. It can be readily understood by one of ordinary skill in the art that fewer or more cycles could be used in the present invention. The automatic cycle will first be described and then the timed cycle.

If the timed cycle has not been selected, the microprocessor determines in step 114 if the "MORE DRY" option has been selected. If yes, in step 116, a counting time T is set to 7.5 X seconds. If the "MORE DRY" cycle has not been selected, the microprocessor determine in step 118 if the "NORMAL DRY" option has been selected. If yes, in step 120, the counting time T is set to 3.75 X seconds. If the "NORMAL DRY" has not been selected, the "DAMP DRY" option has been selected and the microprocessor, in step 122, sets the counting time T is set to X seconds. The value X is determined experimentally and is in the range of between 10–20. The counting time T is used to set a search counter.

In step 124, the microprocessor 46 reads the user selected cycle options. The user then initiates the cycle and energizes the motor by pressing the PTS button 36. The microprocessor enters the first counting period having time T as set above. In step 128, the processor looks for a wet signal during this first counting period. If no wet signals are sensed before the counter runs out, indicating the dryer load is dry or the drum is empty, the processor signals the timer to rapid advance to the WRINKLE GUARD position.

If during a counting period, a wet signal is received, the counter is reset. Accordingly, as shown in step 132, the dryer continues to operate to dry clothes while the processor loops until no wet signals are detected during a counting period. During the automatic drying cycle, the control regulates the temperature of the dryer, by switching transistor 98, in accordance with the sensed exhaust temperature and the selected temperature setting.

Figures 7, 8:
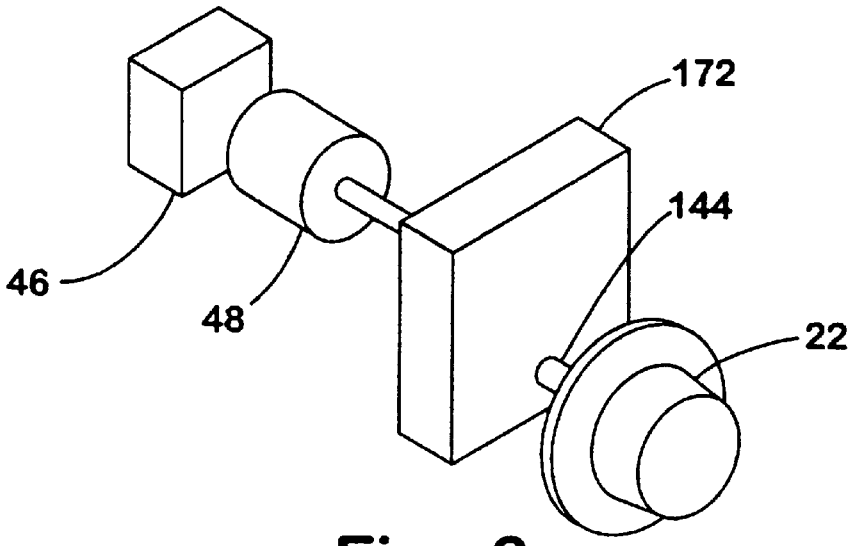
FIG. 7 is a schedule chart of add-on times as a function of the dryness level selected, the selected dry temperature and the run time of the dryer during the moisture sensing period.
FIG. 8 is a schematic illustration of the microprocessor and timer according to the present invention as shown in FIG. 1.

When the search counter has run out, referred to as a dry logic state, the processor 46 drives the timer 44 at a set duty cycle to advance to the "DAMP DRY" position, as shown in step 134. This position can be sensed by the timer switch code, shown in FIG. 6, wherein switches 50 and 52 are closed. After advancing the timer 44, the dryer is operated for an "add-on" period of time, shown in step 136. The add-on time duration is determined in accordance with schedules, stored in the control memory, one of which is shown in FIG. 7 as an example. As can be seen, the add-on time is based upon three inputs: (1) the fabric cycle selected; (2) the dryness level that was selected; and (3) the duration of the drying cycle up to the point when a dry logic state was detected. In this manner, the add-on time is closely tailored to the specific type of clothes being dried, the desired dryness level and the initial dryness condition of the clothes.

Near the end of the add-on time, the heat is reduced, as shown in step 138. Preferably, the last five minutes of the add-on time is a reduced heat period. At the conclusion of the add-on time, the timer 44 is advanced by the processor 46, shown in step 140, to the WRINKLE GUARD position. This position can be sensed by the processor 46 by monitoring the switching contacts 50, 52, 54 and 56. According to the switch code, shown in FIG. 6, the WRINKLE GUARD position is established when switches 50, 52 and 56 are closed. The clothes are then tumbled without heat until the exhaust temperature is less than $T_{exhaust}$ which may be in the range of 95° F.–110° F., step 142, or until ten minutes has elapsed, step 144. In step 146, the processor 46 determines whether a wrinkle guard option has been selected through operation of the selector dial 32. If yes, the dryer is operated through a wrinkle guard cycle, as shown in step 148. If no, the timer is advanced at 100% speed to the off position, in step 150, wherein switch 50 is opened and the processor is deenergized.

Figure 4A:
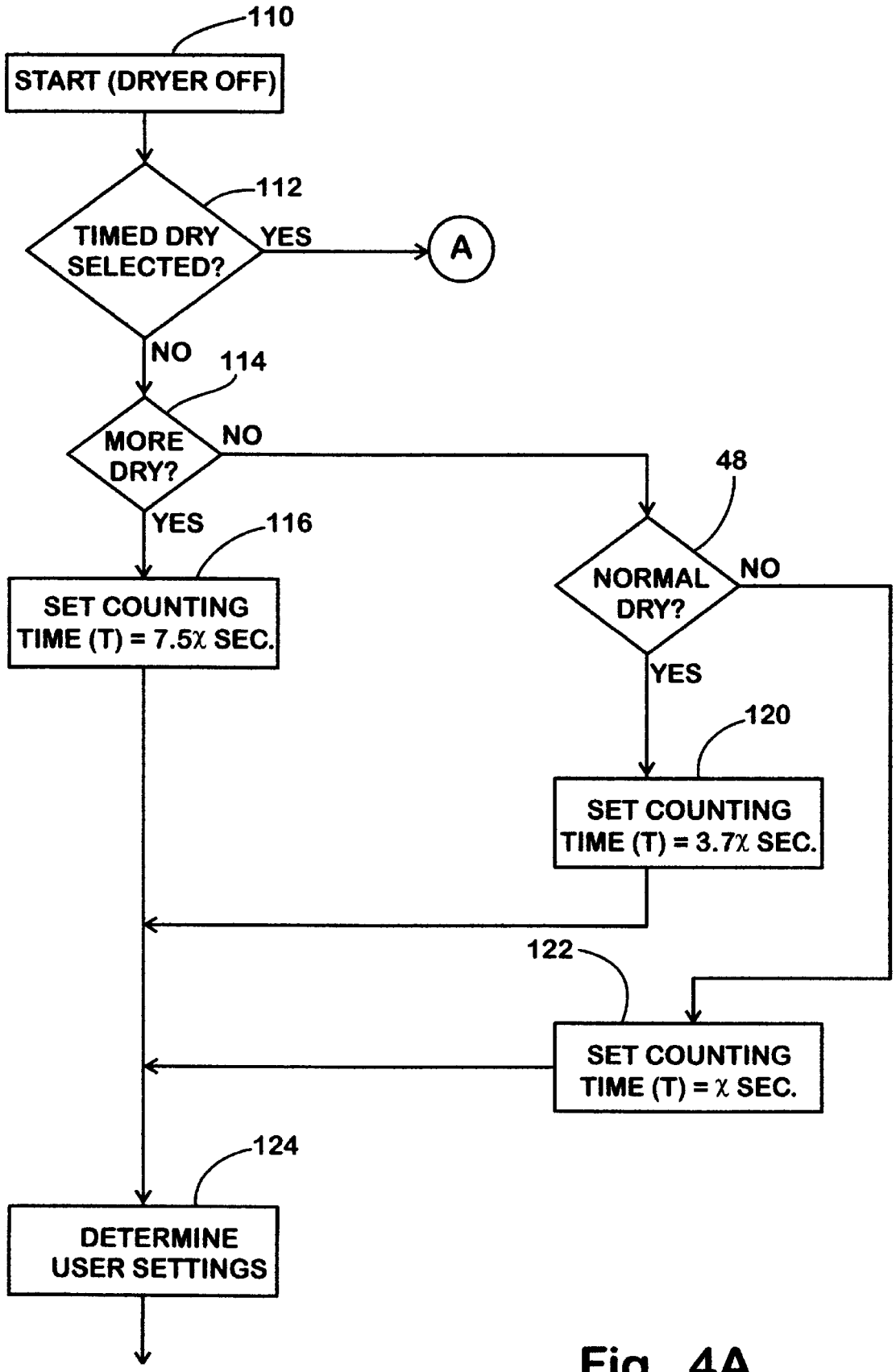
FIGS. 4A, 4B and 4C are flow charts illustrating the operation of the clothes dryer of FIG. 1 in an automatic dry cycle operation.
Figure 4B:
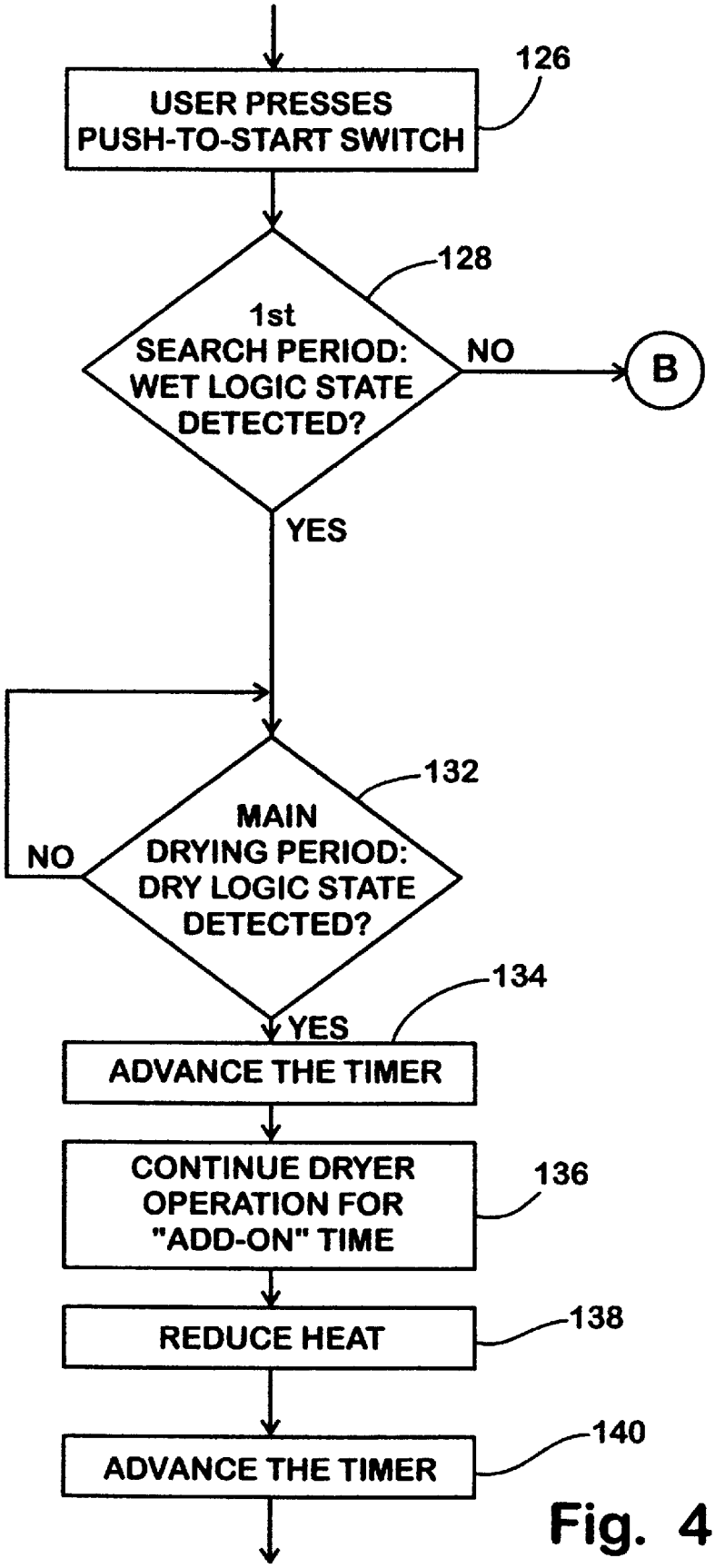
Figure 4C:
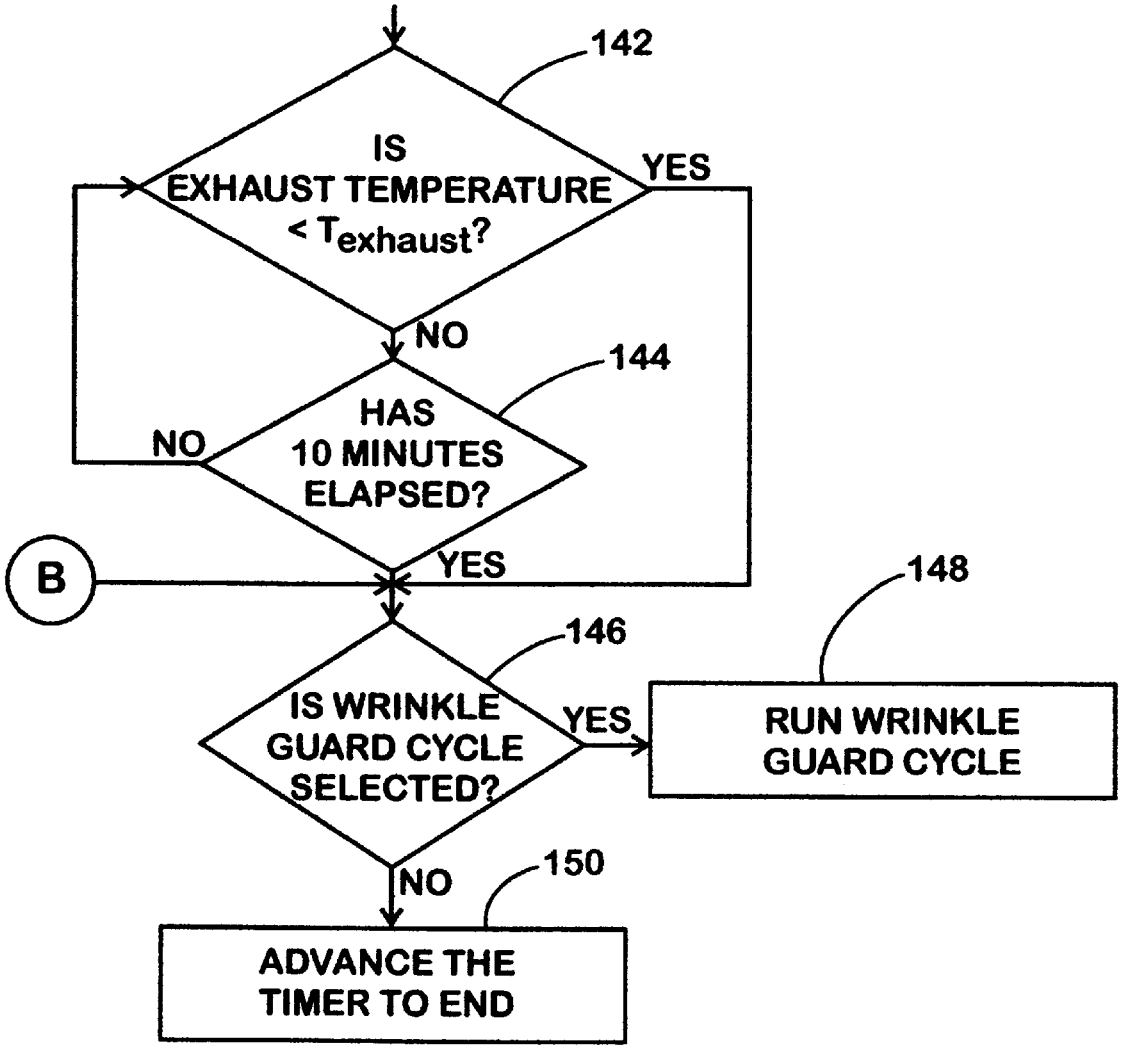
Figure 4D:
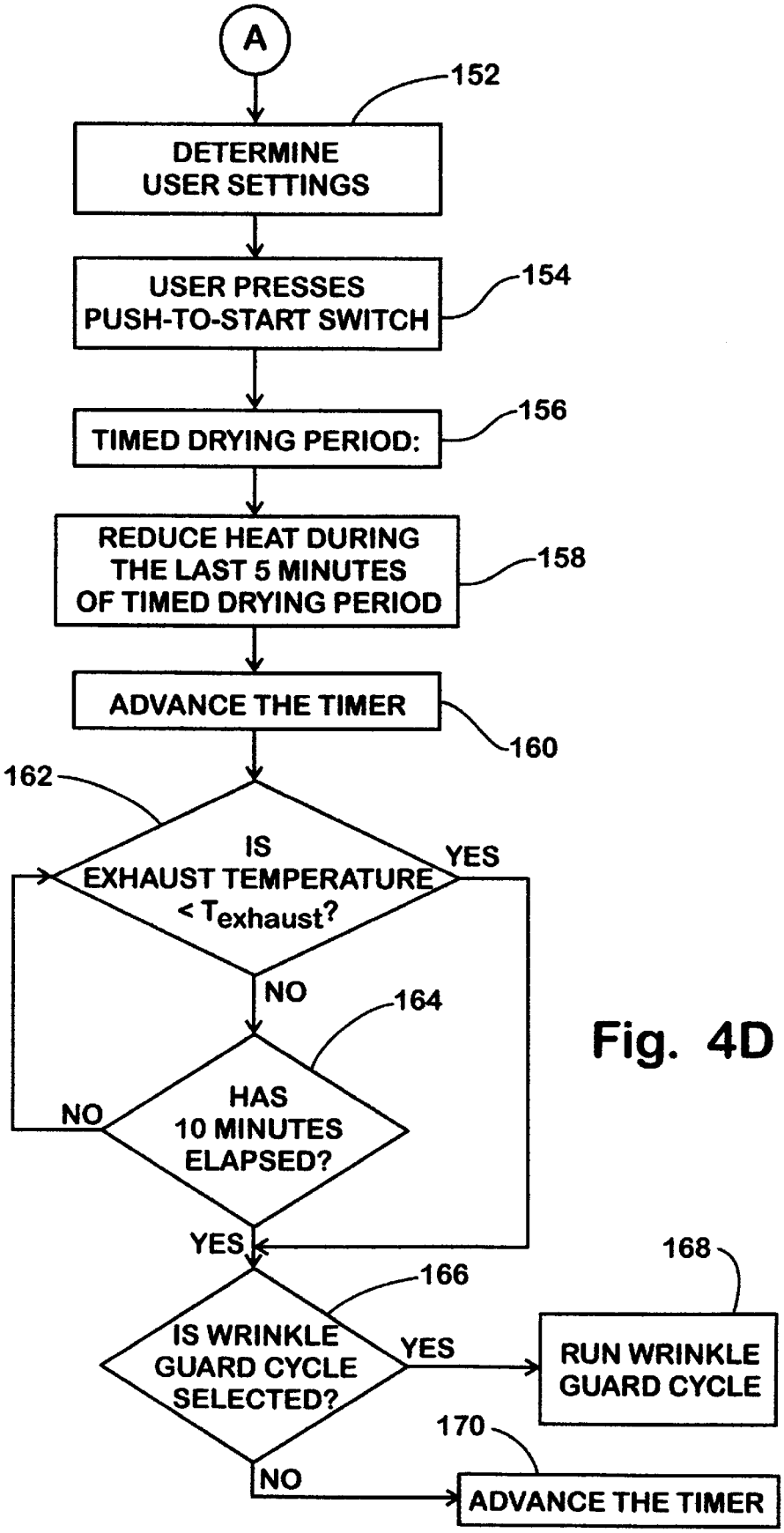
FIG. 4D is a flow chart illustrating the operation of the clothes dryer of FIG. 1 in a timed dry cycle operation.

If in step 112, the user has selected a timed dry cycle of operation, the processor 46 cycles the dryer through a timed dry cycle, as shown in FIG. 4D. In step 152, the microprocessor 46 reads the user selected cycle options. The user then initiates the cycle and energizes the motor by pressing the PTS button 36. As shown in step 156, the microprocessor then operates the dryer during the timed dry cycle for the selected time, driving the timer motor 48 at a predetermined duty cycle such that the timer knob 22 advances to show the dryer progress. During the timed dry cycle, the control regulates the temperature of the dryer in accordance with the sensed exhaust temperature and the selected temperature setting. At the conclusion of the timed dry cycle, the timer 44 is advanced by the processor 46 to the WRINKLE GUARD position, shown in step 160. The clothes are then tumbled without heat until the exhaust temperature is less than $T_{exhaust}$, which may be in the range of 95° F.–110° F., step 162, or until ten minutes has elapsed, step 164. In step 166, the processor 46 determines whether a wrinkle guard option has been selected through operation of the selector dial 32. If yes, the dryer is operated through a wrinkle guard cycle, as shown in step 168. If no, the timer is advanced at 100% speed to the off position, in step 170, wherein switch 50 is opened and the processor is deenergized.

One of the benefits of the present invention is that the timer 44 is controlled in a manner to reflect the status of the dry cycle. To improve responsiveness and speed, the timer motor 48 is associated with a speed reducer gearing system 172 having an output shaft 174 for driving the timer knob 22, as shown in FIG. 8. Typically, a timer motor has a speed reducer gear system wherein the motor speed is greatly reduced to drive the output shaft of the speed reducer gear system at a relatively slow speed of rotation. For example, a typical timer motor may be reduced in speed to drive a timer knob to make one 360° rotation in 3 hours (0.033° /sec or 0.00058 rad/sec). In contrast, the present invention is such that the ratio between the motor 48 and the output shaft 174 causes the output shaft, and hence the timer knob, to be rotated relatively rapidly. For example, the present invention is configured such that the timer knob 22 may be driven to make one complete 360° rotation in between 3–6 minutes. Accordingly, the rotational velocity of the timer knob is in the range between 1°/sec–2°/sec (or 0.017 rad/sec–0.035 rad/sec). Because of the present invention's relatively high gear ratio, the processor 46 can drive the timer 44 in a relatively rapid manner when desired. Alternatively, the processor 46 can cycle the timer motor 48 on and off according to a plurality of predetermined duty cycles such that the timer 44 may be advanced at any of a plurality of predetermined speeds.

Looking now at the dryer operation, as discussed above, the processor 46 controls transistor 80 to advance the timer 44 during different steps of the dry cycle. Specifically, the processor advances the timer during steps 134, 140 and step 150 of the automatic drying cycle and steps 156, 160 and 170 of the timed drying cycle. During steps 134 and 140, the timer operates the transistor 80 to achieve an 6%–12% duty cycle wherein the timer motor 48 is periodically energized for a short time (2–8 seconds) and is then deenergized a period of time (25–40 seconds). As can be understood, under such a duty cycle, the timer knob 22 moves relatively slowly. For example, an 8% duty cycle results in movement of the timer knob from the NORMAL DRY position to the DAMP DRY position in approximately 10 minutes. In other situations, it is desired to rapidly advance the timer 44. For example, if during step 128, no wet signals are received during the first counting period, the timer is rapidly advance at 100% energization to the wrinkle guard position. Similarly, in step 150, since the dry cycle is over, the processor 46 advances the timer at 100% energization such that the timer rapidly moves to an end position.

In a similar manner, during the timed drying cycle of operation in step 156, the processor 46 drives the timer motor 48 at a predetermined duty cycle wherein the timer motor 48 is periodically energized and then deenergized. For example, the duty cycle may be 6% and the timer may be operated 7 seconds on, 113 seconds off. In this manner, the timer knob 22 is driven to rotate at an appropriate rotational speed to provide an indication of the time cycle status. At other points in the timed dry cycle, at steps 160 and 170, it is desired to move the timer knob rapidly wherein the processor drives the timer motor 48 at 100% energization. It can be seen, therefore, that the combination of the processor 46 and timer 44 allow for a responsive and rapid movement of the timer knob 22 to provide feed back to the user regarding the status of the dry cycle.

In this fashion therefore, a novel control system for a dryer combining an electronic circuit or microprocessor with a timer is provided. The control system is responsive to the moisture level of the clothes, provides feedback regarding the cycle status and operates to dry clothes in an efficient and rapid manner. The control system of the present invention may be readily applied to either an electric (120 volt or 240 volt) or gas combustion type dryer.

Although the present invention has been described with reference to a specific embodiment, those of skill in the Art will recognize that changes may be made thereto without departing from the scope and spirit of the invention as set forth in the appended claims.

We claim:

1. A control for a clothes dryer, the clothes dryer having a drum for receiving clothes, a drive motor for rotating the drum and for operating a blower for circulating air through the drum, and a heater for heating air circulated through the drum, the control comprising:

an electronic circuit;

an electromechanical timer having a plurality of switches for signaling the timer position to the electronic circuit such that the timer and the electronic circuit operate together to control the operation of the clothes dryer;

a timer knob drivingly connected to the timer such that the timer position is initially controlled by the rotation of the timer knob; and a sensor for supplying a signal to the electronic circuit corresponding to the moisture level of the clothes within the drum wherein the electronic circuit operates to control operation of the clothes dryer in response to the initial timer position and further wherein the electronic circuit cycles the timer on and off according to a predetermined duty cycle to advance the timer in response to the sensor signal such that cycle status information corresponding to the sensed moisture level is displayed by the position of the timer knob.

2. The clothes dryer control according to claim 1, wherein the electronic control cycles the timer on and off according to a plurality different duty cycles to advance the timer at a plurality of different speeds.

3. The clothes dryer control according to claim 1, further comprising:

means for inputting cycle selections to the electronic circuit, wherein the electronic circuit cycles the timer on and off according to a plurality of predetermined duty cycles such that the cycle status information corresponds to the drying progress, the duty cycle being determined based on the inputted cycle selections.

4. The clothes dryer control according to claim 1 wherein:

the electronic circuit comprises a microprocessor having a plurality of input ports;

the plurality of switches are associated with the plurality of input ports; and the plurality of switches of the timer are associated with a plurality of different angular timer positions for selecting between a plurality of different dryness levels such that the desired dryness level can be input to the electronic circuit by rotating the timer to the desired angular position by operation of the timer knob.

5. The clothes dryer control according to claim 1, wherein the electromechanical timer includes a switch for supplying power to the electronic circuit.

6. The clothes dryer according to claim 1, further comprising:

a plurality of cams associated with the plurality of switches such that the plurality of timer switches open and close in response to the cams at predetermined angular positions wherein the switches provide control input to the electronic circuit for initiating the dry cycle and further provide control input to the electronic circuit during the dry cycle such that the electromechanical timer and the electronic circuit operate together to control the dryer operation.

7. The clothes dryer control according to claim 1 wherein the electromechanical timer further comprises:

a motor;

an output shaft connected to the timer knob; and a speed reducer gear system interconnected between the motor and the output shaft having a speed reduction ratio such that the timer knob rotates at an angular velocity no slower than 0.0044 rad/sec when the motor is energized.

8. The clothes dryer control according to claim 1, further wherein:

the timer knob may be rotated to select between a timed cycle of operation and an automatic cycle of operation;

the timer includes a timer motor; and the electronic circuit includes means for driving the timer motor according to a first duty cycle during the timed cycle of operation and according to a second duty cycle during the automatic cycle of operation.

9. The clothes dryer control according to claim 1, further wherein:

the timer knob may be rotated to select between a timed cycle of operation and an automatic cycle of operation;

the electronic circuit includes means for driving the timer according to a first duty cycle during the timed mode of operation; and the electronic circuit including means to pause the timer until a predetermined degree of moisture is sensed and then drive the timer according to a second duty cycle when the automatic cycle of operation is selected.

10. The clothes dryer control according to claim 1, further comprising:

means for selecting a desired drying temperature;

means for selecting a desired dryness level;

means for operating the dryer for a drying period, wherein during the drying period the drive motor is energized and the heater is intermittently energized to maintain the selected drying temperature until a moisture level correlated to the desired dryness is sensed; and means for continuing operation of the drive motor and intermittent energization of the heater for an additional time based on the desired dryness level, the selected temperature and the time elapsed during the drying period.

11. The clothes dryer control according to claim 1, further comprising:

means for terminating the dryer cycle if no moisture is sensed in the clothes load upon initial energization of the clothes dryer.

12. The clothes dryer control according to claim 1, further comprising:

means for selecting between an automatic cycle of operation a timed cycle of operation;

means for monitoring moisture level signals from the from the sensor if the automatic cycle is selected; and means for pausing the monitoring of the moisture signals for a predetermined period of time if a moisture signal is sensed upon the initial energization of the clothes dryer.

13. A method for operating a clothes dryer, the clothes dryer having a drum for receiving clothes, a drive motor for rotating the drum and for operating a blower for circulating air through the drum, and a heater for heating air circulated through the drum, the method comprising the steps of:

selecting a desired drying temperature;

selecting a desired dryness level;

sensing the moisture level in the clothes within the drum;

operating the dryer for a drying period, wherein during the drying period the drive motor is energized and the heater is intermittently energized to maintain the selected drying temperature until the a moisture level correlated to the desired dryness is sensed; and then continuing operation of the drive motor and intermittent energization of the heater for an additional time based on the desired dryness level, the selected temperature and the time elapsed during the drying period.

14. The method according to claim 13, further comprising the steps of:

terminating the dryer cycle if no moisture is sensed in the clothes load upon initial energization of the clothes dryer.

15. The method according to claim 13 wherein the clothes dryer includes an electromechanical timer having a timer knob, a timer motor and a speed reducer gear system interconnected between the motor and the timer knob, the method further comprising:

driving the timer knob to rotate at an angular velocity no slower than 0.0044 rad/sec when the motor is energized.

16. The method of operating a clothes dryer according to claim 13, further comprising the steps of;

continuing the operation of the drive motor without the energization of the heater to allow the clothes to cool down after the additional timer has elapsed; and terminating the dry cycle.

* * * * *